US012599228B2

(12) United States Patent
Brolley et al.

(10) Patent No.: US 12,599,228 B2
(45) Date of Patent: Apr. 14, 2026

(54) LOCATING SLOT FOR A TRIGGER SUPPORT ARM OF A SLIDE ASSEMBLY

(71) Applicant: Haier US Appliance Solutions, Inc., Wilmington, DE (US)

(72) Inventors: Justin James Brolley, New Albany, IN (US); Benjamin Carl Maddux, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 254 days.

(21) Appl. No.: 18/488,759

(22) Filed: Oct. 17, 2023

(65) Prior Publication Data

US 2025/0120503 A1 Apr. 17, 2025

(51) Int. Cl.
*A47B 57/58* (2006.01)
*A47L 15/50* (2006.01)

(52) U.S. Cl.
CPC ..... *A47B 57/583* (2013.01); *A47L 15/507* (2013.01)

(58) Field of Classification Search
CPC ..... A47B 57/583; A47B 88/473; A47B 2088/401; A47L 15/507; A47L 15/4246
USPC ..... 312/228.1
See application file for complete search history.

(56) References Cited

U.S. PATENT DOCUMENTS 3,799,640 A * 3/1974 Jacobs ..... E05B 65/463 312/273
5,657,878 A * 8/1997 Austin ..... A47L 15/504 211/208
7,377,500 B2 5/2008 Tomiji et al.
7,607,444 B2 10/2009 Gunnerson et al.
7,945,993 B2 5/2011 Tomioka et al.
8,205,951 B2 6/2012 Boks
8,387,634 B2 3/2013 Dalsing
8,393,693 B2 3/2013 Juan et al.
8,414,094 B2 4/2013 Chi et al.
8,419,142 B2 4/2013 Zimmermann
8,449,051 B2 5/2013 Lam et al.
8,459,758 B2 6/2013 Rechberg et al.
8,511,764 B1 8/2013 Chen
8,888,200 B2 11/2014 Sato
8,939,525 B1 1/2015 Chen
9,032,978 B2 5/2015 Kiechle et al.
9,049,977 B2 6/2015 Jobst et al.
9,055,851 B2 6/2015 Johansson
(Continued)

FOREIGN PATENT DOCUMENTS

WO WO2009141307 A1 11/2009
WO WO2012119845 A1 9/2012
(Continued)

*Primary Examiner* — James O Hansen
(74) *Attorney, Agent, or Firm* — Dority & Manning, P.A.

(57) ABSTRACT

A trigger assembly of a slide assembly may define a vertical direction, a lateral direction, and a transverse direction. The slide assembly may include a soft close mechanism. The trigger assembly may include a trigger support arm. The trigger support arm may include a first member and a second member. The second member may be extended approximately along the vertical direction. The first member may be extended from the second member approximately along the transverse direction. The second member may include a slot defined therethrough. The trigger support arm may be located to the slide assembly via the slot.

14 Claims, 13 Drawing Sheets

(56) References Cited

U.S. PATENT DOCUMENTS

| | | | |
|---|---|---|---|
| 9,107,500 | B2 | 8/2015 | Zimmermann |
| 9,364,089 | B1 | 6/2016 | Chen et al. |
| 9,388,619 | B2 | 7/2016 | Park et al. |
| 9,420,882 | B2 | 8/2016 | Garcia et al. |
| 9,486,077 | B2 | 11/2016 | Brock |
| 9,642,460 | B2 | 5/2017 | Chen et al. |
| 9,968,193 | B1 | 5/2018 | Chen et al. |
| 10,051,963 | B2 | 8/2018 | Azkue et al. |
| 10,053,902 | B1 | 8/2018 | White et al. |
| 10,058,176 | B2 | 8/2018 | Rehage |
| 10,159,344 | B2 | 12/2018 | Mason et al. |
| 10,159,398 | B2 | 12/2018 | Wilson et al. |
| 10,165,856 | B2 | 1/2019 | Gleixner et al. |
| 10,292,494 | B1 | 5/2019 | Huang et al. |
| 10,638,838 | B2 | 5/2020 | Stöckli et al. |
| 10,667,608 | B2 | 6/2020 | Rehage et al. |
| 10,736,421 | B2 | 8/2020 | Liao et al. |
| 10,758,043 | B2 | 9/2020 | Pohlmann |
| 11,039,688 | B2 | 6/2021 | Pecar et al. |
| 11,317,783 | B2 | 5/2022 | Scalf et al. |
| 11,395,546 | B2 | 7/2022 | Lee et al. |
| 11,406,186 | B2 | 8/2022 | Chen et al. |
| 2004/0163687 | A1 | 8/2004 | Son et al. |
| 2008/0067905 | A1 | 3/2008 | Guiles et al. |
| 2010/0244642 | A1 | 9/2010 | Radusin et al. |
| 2014/0042884 | A1 | 2/2014 | Domenig et al. |
| 2019/0226259 | A1 | 7/2019 | Gherardi |
| 2020/0115945 | A1 | 4/2020 | Akca et al. |
| 2021/0212461 | A1 | 7/2021 | Stuffel et al. |
| 2022/0202271 | A1 | 6/2022 | Tütek |
| 2022/0240672 | A1 | 8/2022 | Duggins |

FOREIGN PATENT DOCUMENTS

| | | | |
|---|---|---|---|
| WO | WO2015167853 | A1 | 11/2015 |
| WO | WO2018082804 | A2 | 5/2018 |
| WO | WO2019223972 | A1 | 11/2019 |
| WO | WO2020007469 | A1 | 1/2020 |
| WO | WO2022030720 | A1 | 2/2022 |

* cited by examiner

LOCATING SLOT FOR A TRIGGER SUPPORT ARM OF A SLIDE ASSEMBLY

FIELD OF THE DISCLOSURE

The present subject matter relates generally to a slide assembly for supporting a rack assembly, such as in a dishwashing appliance.

BACKGROUND OF THE DISCLOSURE

Dishwashing appliances generally include a tub that defines a wash chamber. Rack assemblies can be mounted within the wash chamber of the tub for receipt of articles for washing. Certain dishwashing appliances also include slide assemblies for supporting and enabling movement of the rack assemblies. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

Some existing slide assemblies include a soft close mechanism for dampening movement of the slide assembly. In such instances, a trigger assembly attached to the slide assembly can be utilized to trigger, e.g., activate, the soft close mechanism. However, trigger assemblies can often be difficult for an operator of the dishwashing appliance to assemble as they may be located in tight spaces within the dishwashing appliance.

Accordingly, slide assemblies addressing one or more of the above issues would be useful. In particular, it would be advantageous to provide a trigger assembly that includes locating features for improved assembly.

BRIEF DESCRIPTION OF THE DISCLOSURE

Aspects and advantages of the invention will be set forth in part in the following description, or may be apparent from the description, or may be learned through practice of the invention.

In one exemplary aspect of the present disclosure, a dishwashing appliance is provided. The dishwashing appliance may define a vertical direction, a lateral direction, and a transverse direction. The dishwashing appliance may include a tub. The tub may define a wash chamber. The dishwashing appliance may also include a rack assembly positioned within the wash chamber. The dishwashing appliance may further include a slide assembly mounted to the tub. The slide assembly may include a soft close mechanism. The soft close mechanism may include an actuator to dampen movement of the slide assembly. The rack assembly may be slidably mounted to the slide assembly to transition the rack assembly between an extended loading position and a retracted position. The dishwashing appliance may further include a trigger assembly. The trigger assembly may include a trigger support arm. The trigger support arm may include a first member and a second member. The second member may be extended approximately along the vertical direction. The first member may be extended from the second member approximately along the transverse direction. The second member may include a slot defined therethrough. The trigger support arm may be located to the slide assembly via the slot.

In another exemplary aspect of the present disclosure, a trigger assembly of a slide assembly for a dishwashing appliance is provided. The slide assembly may define a vertical direction, a lateral direction, and a transverse direction. The slide assembly may include a soft close mechanism. The trigger assembly may include a trigger support arm. The trigger support arm may include a first member and a second member. The second member may be extended approximately along the vertical direction. The first member may be extended from the second member approximately along the transverse direction. The second member may include a slot defined therethrough. The trigger support arm may be located to the slide assembly via the slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
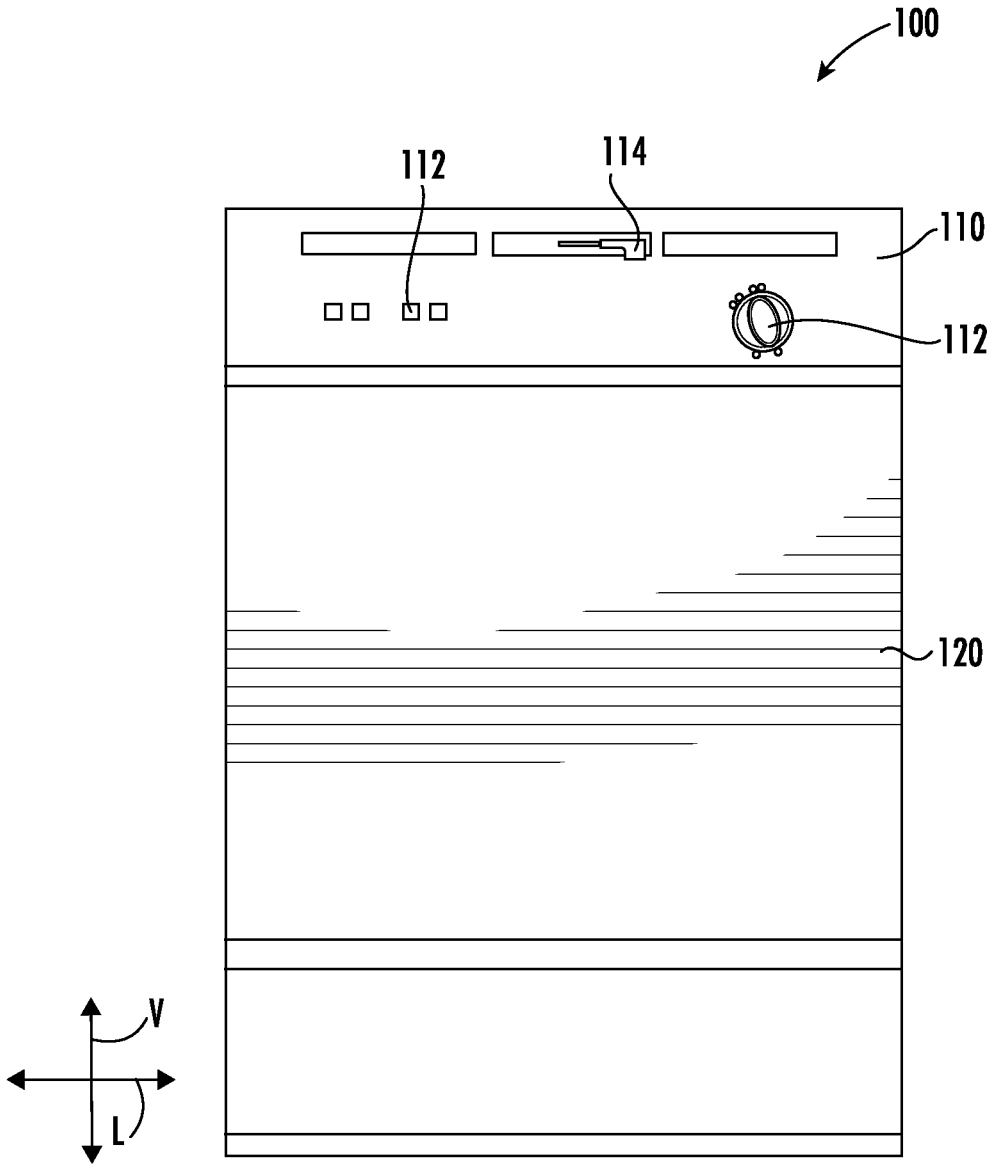
FIG. 1 provides a front elevation view of a dishwashing appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
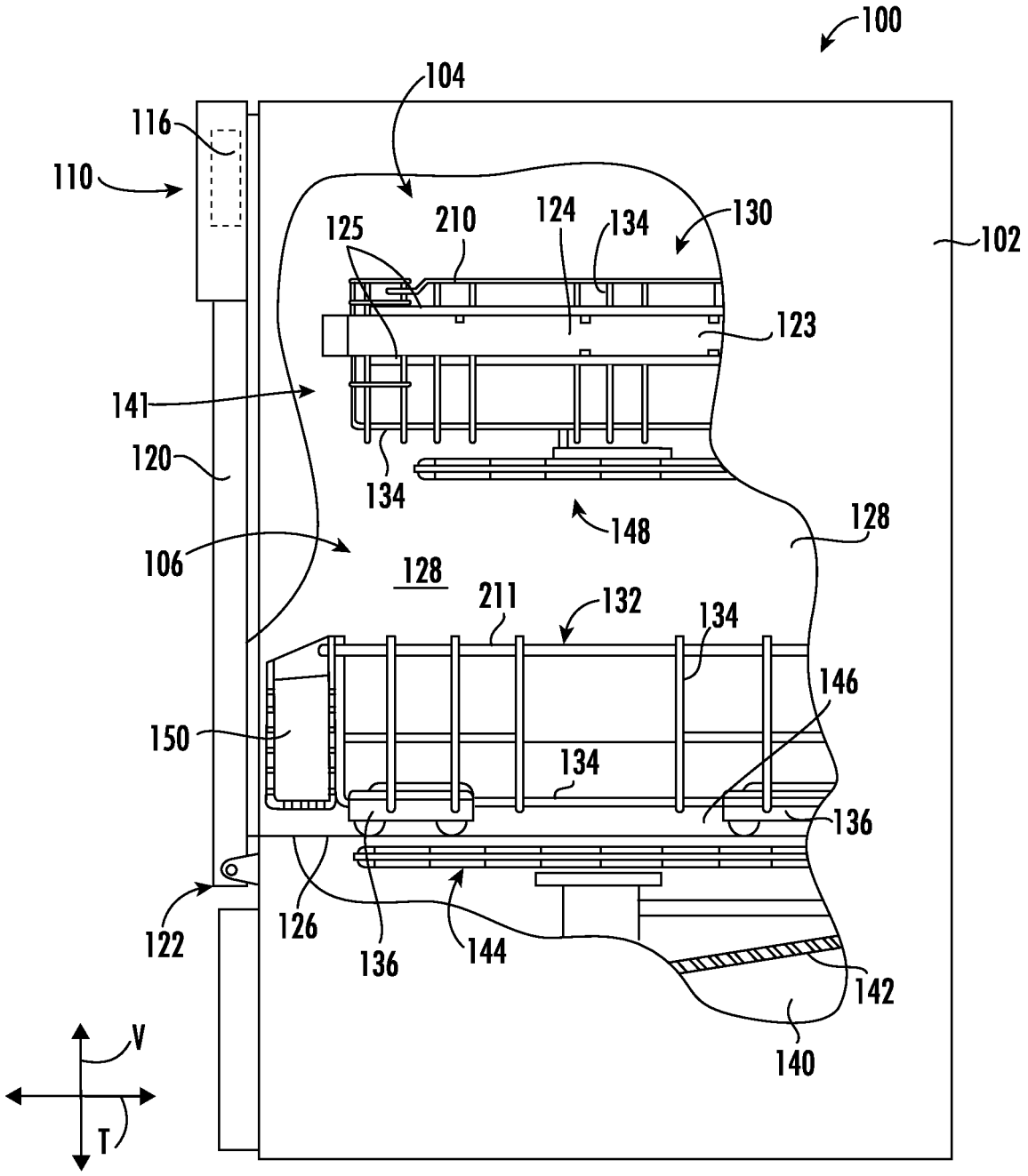
FIG. 2 provides a side, partially cut away view of the exemplary dishwashing appliance of FIG. 1.

Referring now to FIGS. 1 and 2, a dishwashing appliance 100 according to one or more exemplary embodiments of the present subject matter is provided. Specifically, FIG. 1 provides a front elevation view of the dishwashing appliance 100 and FIG. 2 provides a side, partially cut away view of the dishwashing appliance 100 of FIG. 1. As depicted, the dishwashing appliance 100 may define a vertical direction V, a lateral direction L, and a transverse direction T. The vertical direction V, the lateral direction L, and the transverse direction T each being mutually perpendicular with every other, such that an orthogonal direction system is generally defined.

The dishwashing appliance 100 may include a cabinet 102 having a tub 104 therein that defines a wash chamber 106. The tub 104 may include a front opening and a door 120 that may be hinged at a bottom 122 for movement between a normally closed vertical position, e.g., FIGS. 1 and 2, wherein the wash chamber 106 is sealed shut for washing operation, and a horizontal open position (not depicted), wherein the loading and unloading of articles from the dishwashing appliance 100 may occur. In some instances, such as depicted in FIG. 1, the dishwashing appliance 100 may include a latch 114 that may be used to lock and unlock the door 120 such that access to the wash chamber 106 may be permitted or restricted.

In addition, the dishwashing appliance 100 may include one or more rack assemblies, such as an upper rack assembly 130 and a lower rack assembly 132, that may be used to load articles in the dishwashing appliance 100. In some embodiments, the upper rack assembly 130 may be mounted within the dishwashing appliance 100 in an upper region 141 of the wash chamber 106, e.g., above the lower rack assembly 132 with respect to the vertical direction V. The rack assemblies 130, 132 may each be adapted for movement substantially along the transverse direction T between an extended loading position (not shown) in which the respective rack assembly 130, 132 is positioned substantially outside the wash chamber 106 and a retracted position, e.g., FIGS. 1 and 2, in which the respective rack assembly 130, 132 may be located entirely within the wash chamber 106. As illustrated in FIG. 2, the movement of the upper rack assembly 130 may be facilitated by a pair of slide assemblies 124 that may be positioned at opposing lateral sides of the upper rack assembly 130. Additionally, as illustrated in FIG. 2, the movement of the lower rack assembly 132 may be facilitated by a pair of roller assemblies 136 that may be positioned at opposing lateral sides of the lower rack assembly 132.

One of ordinary skill in the art would understand that the pair of slide assemblies 124 and the pair of roller assemblies 136 are provided by way of example only. For instance, in alternative exemplary embodiment, the movement of the upper rack assembly 130 and the lower rack assembly 132 may each be facilitated by a respective pair of slide assemblies such as the pair of slide assemblies 124.

The rack assemblies 130, 132 may each include a dish rack for holding articles therein, e.g., for the cleaning of the articles. For instance, the upper rack assembly 130 may include an upper dish rack 210 and the lower rack assembly 132 may include a lower dish rack 211. The dish racks 210, 211 may each include a plurality of elongated members or rails 134 that may each be extended in the lateral direction L, the transverse direction T, and the vertical direction V. The plurality of rails 134 may be wires, rods, or any other suitable member, which may be fabricated into a lattice structure to form the shape of the respective dish rack 210, 211.

As depicted and described herein, the pair of slide assemblies 124 may include or be provided as a pair of ball bearing slide assemblies 124 that each include an inner rail 123 and outer rail 125. The inner rail 123 may be mounted to, fixed to, or attached to, a lateral tub side wall 128 of the tub 104. The outer rail 125 may be attached to or mounted to a respective lateral side of a corresponding dish rack (e.g., the upper dish rack 210). In some embodiments, the outer rails 125 are slidably mounted onto the respective inner rail 123 such that the outer rails 125 may slide along the respective inner rail 123, e.g., to move the upper rack assembly 130 between the extended loading position and the retracted position. Additionally or alternatively, in some embodiments, the pair of slide assemblies 124 include an intermediate rail 127. As will be further described below, the intermediate rail 127 may include one or more rail caps 222 that each may be attached to a respective transverse end of the intermediate rail 127. Each rail cap 222 may be used to cover the respective transverse end of the intermediate rail 127. For instance, in some embodiments, the intermediate rail 127 may be constructed from a material, for example, metal, that may include exposed edges. Each rail cap 222 may be used to protect a user from the exposed metal edges of the intermediate rail 127.

In addition, lower guides 126 may be positioned in opposing manner of the sides of chamber 106 and provide a ridge or shelf for roller assemblies 136 so as to support and provide movement for the lower rack assembly 132.

Optionally, a silverware basket 150 may be removably attached to the lower rack assembly 132 for placement of silverware, small utensils, and the like, which are too small to be accommodated by the upper rack assembly 130 and the lower rack assembly 132.

Further, the dishwashing appliance 100 may include a lower spray assembly 144 that may be rotatably mounted within a lower region 146 of the wash chamber 106 and above a tub sump portion 142 so as to rotate in relatively close proximity to the lower rack assembly 132, e.g., in closer proximity to the lower rack assembly 132 than to the upper rack assembly 130. In addition, the dishwashing appliance 100 may include a mid-level spray assembly 148 that may be located in the upper region 141 of the wash chamber 106 and may be attached to, or located in close proximity to, the upper rack assembly 130, e.g., the mid-level spray assembly 148 may be in "close proximity" to the upper rack assembly 130 in that the mid-level spray assembly 148 is closer to the upper rack assembly 130 than to the lower rack assembly 132. In some embodiments an upper spray assembly (not shown) may additionally be located above the upper rack assembly 130.

The lower spray assembly 144, the mid-level spray assembly 148, and the upper spray assembly may be fed by a fluid circulation assembly that may be configured for circulating water and wash fluid in the tub 104. Portions of the fluid circulation assembly may be located in a machinery compartment 140 located below the bottom sump portion 142 of the tub 104, as generally recognized in the art. Each spray assembly, e.g., lower spray assembly 144, mid-level spray assembly 148, and upper spray assembly, may include an arrangement of discharge ports or orifices for directing washing liquid onto dishes or other articles located in the upper rack assembly 130 and the lower rack assembly 132, respectively. The arrangement of the discharge ports in at least the lower spray assembly 144 may provide a rotational force by virtue of the washing fluid flowing through the discharge ports. The resultant rotation of the lower spray assembly 144 may provide coverage of dishes and other articles with a washing spray.

The dishwashing appliance 100 may further be equipped with a controller 116 to regulate operation of dishwashing appliance 100. The controller 116 may include a memory (e.g., non-transitive memory) and microprocessor, such as a general or special purpose microprocessor operable to execute programming instructions or micro-control code associated with a cleaning cycle. The memory may represent random access memory such as DRAM or may represent read only memory such as ROM or FLASH. In one embodiment, the processor executes programming instructions stored in memory. The memory may be a separate component from the processor or may be included onboard within the processor.

The controller 116 may be positioned in a variety of locations throughout dishwashing appliance 100. For example, as depicted in FIGS. 1 and 2, the controller 116 may be located within a control panel area 110 of the door 120. In such an embodiment, input/output ("I/O") signals may be routed between the control system and various operational components of dishwashing appliance 100 along wiring harnesses that may be routed through bottom 122 of door 120. In certain embodiments, the control panel area 110 may include input components 112 through which a user may select various operational features and modes and monitor progress of the dishwashing appliance 100. For instance, in some embodiments, input components 112 may be a variety of electrical, mechanical, or electro-mechanical input devices including rotary dials (e.g., FIG. 1), push buttons (e.g., FIG. 1), or touch pads, etc. In some embodiments, the control panel area 110 may include a display component, such as a digital or analog display device designed to provide operational feedback to a user. The input components 112 may be in communication with controller 116 via one or more signal lines or shared communication busses.

It should be appreciated that the present subject matter is not limited to any particular style, model, or configuration of dishwashing appliance. Thus, the exemplary embodiment depicted in FIGS. 1 and 2 are for illustrative purposes only. For example, different locations may be provided for the input components 112, different configurations may be provided for the upper rack assembly 130 and the lower rack assembly 132, and other differences may be applied as well.

Only a single slide assembly 124 (or elements thereof) is illustrated in FIGS. 3 through 7 and described in the following corresponding paragraphs for the sake of clarity and simplicity. Those of ordinary skill in the art will understand that the exemplary slide assembly 124 shown and described in FIGS. 3 through 7 may be one of a pair. For example, a second slide assembly may be provided opposite the illustrated slide assembly 124. As would be understood, such a second slide assembly may be provided on an opposite tub side wall 128 (e.g., at the same vertical height as the first slide assembly 124). Additionally or alternatively, the second slide assembly may be a substantial duplicate of the illustrated and described slide assembly 124, such as a mirrored version of the illustrated and described slide assembly 124.

Figure 3:
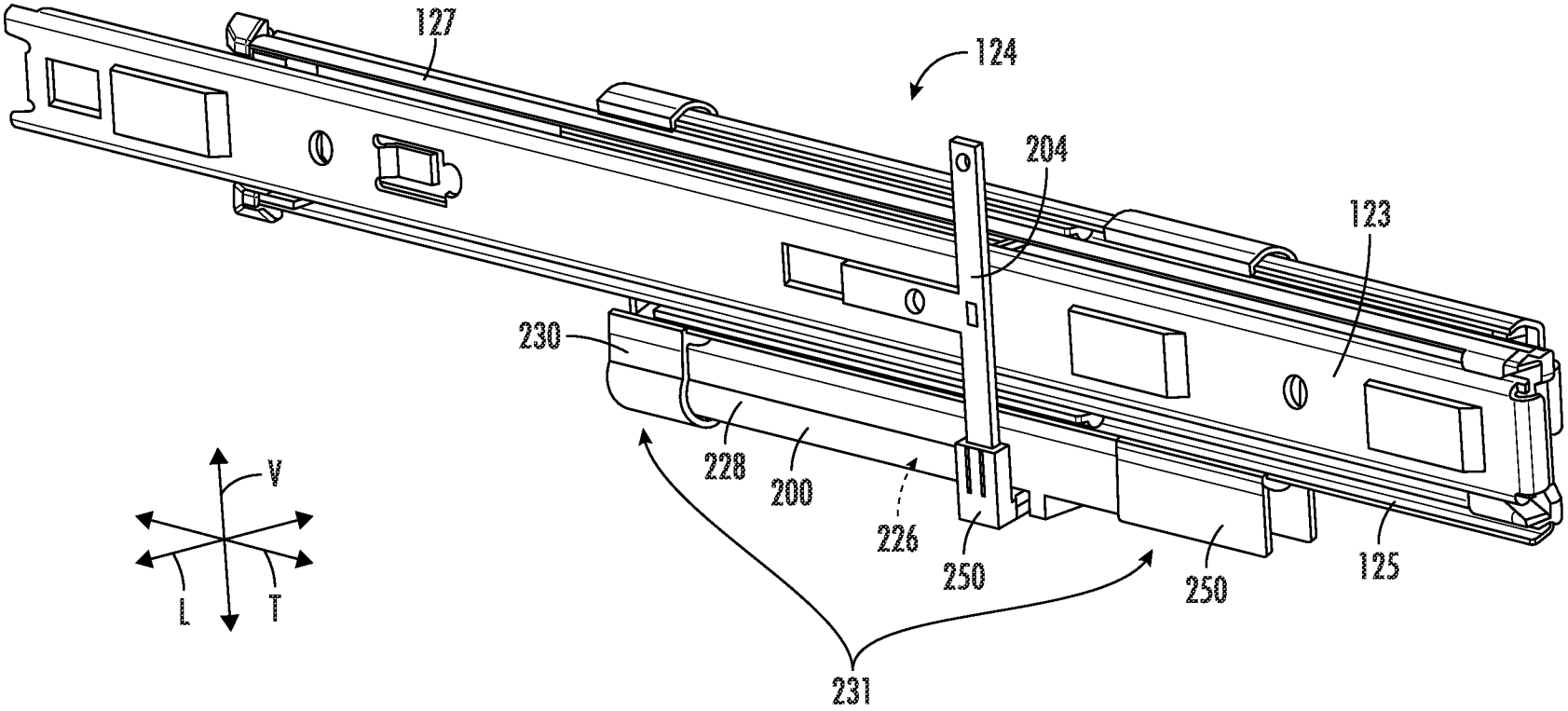
FIG. 3 provides a perspective view of a slide assembly that may be incorporated into a dishwashing appliance, such as the dishwashing appliance of FIG. 1, according to one or more exemplary embodiments of the present subject matter.
Figure 4:
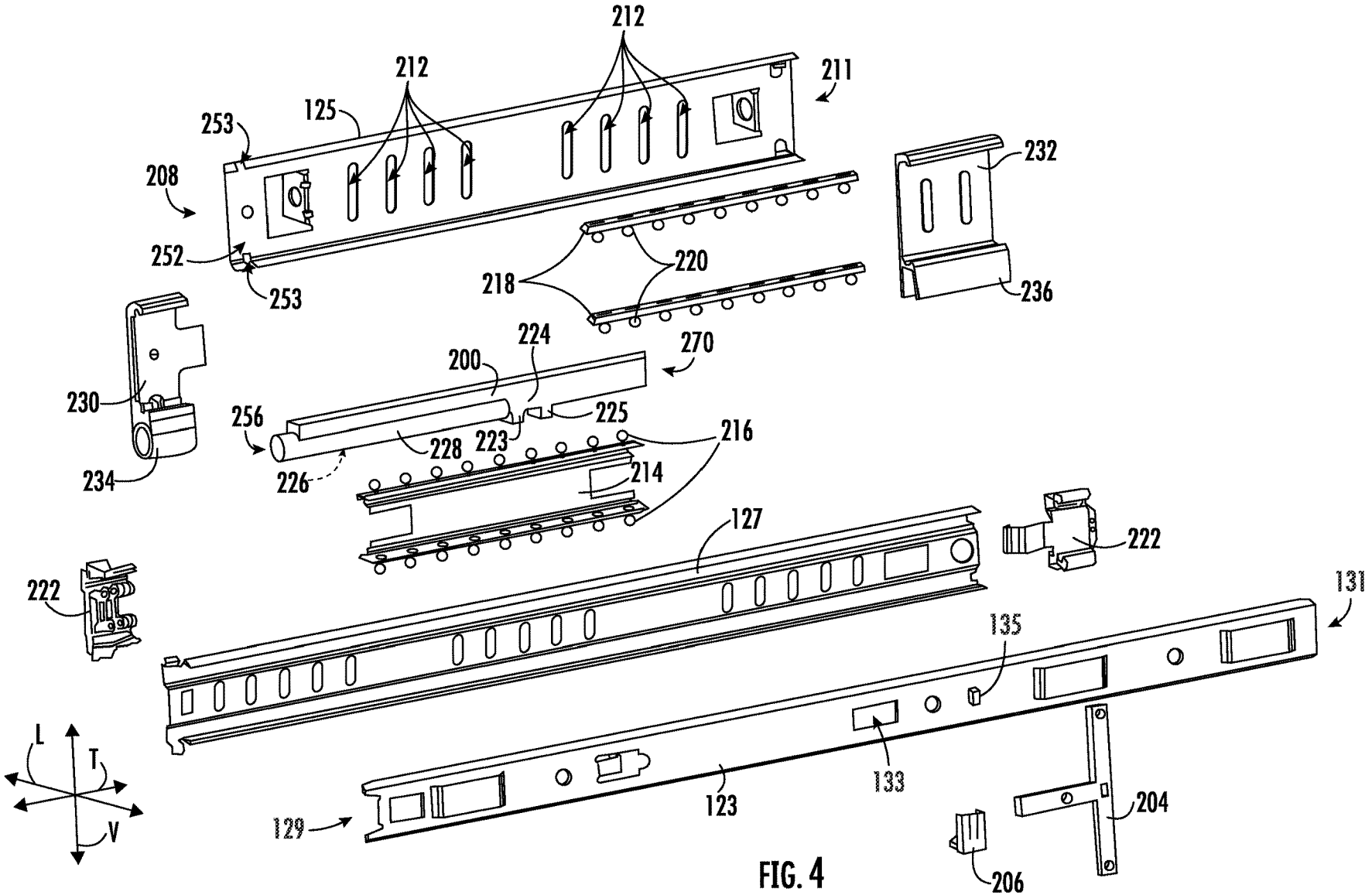
FIG. 4 provides an exploded view of the exemplary slide assembly of FIG. 3.

Referring now to FIGS. 3 and 4, an exemplary slide assembly 124 is provided according to one or more exemplary embodiments of the present subject matter. Specifically, FIG. 3 depicts a perspective view of the slide assembly 124 and FIG. 4 depicts an exploded view of the slide assembly 124. Moreover, the vertical direction V, the lateral direction L, and the transverse direction T described herein, with respect to the various elements of the slide assembly 124 are, except as otherwise indicated, generally understood to correspond to the position of those elements when slide assembly 124 may be attached within wash chamber 106. For example, slide assembly 124 may be attached to the side wall 128 (e.g., via one or more suitable fasteners, screws, bolts, rivets, welds, adhesives, or molded joints). When assembled, slide assembly 124 may extend substantially in or along the transverse direction T. In use, slide assembly 124 may be able to transition, or slide, a dish rack, such as the upper dish rack 210, substantially in or along the transverse direction T.

In some embodiments, the slide assembly 124 is mounted within the wash chamber 106, for instance, to one of the side walls 128 of the tub 104. In addition, the slide assembly 124 may be provided to transition the rack assembly, for example, the upper rack assembly 130 (FIG. 2), between an extended loading position (not pictured) and a retracted position (e.g., FIG. 3). As will be described in greater detail below, the slide assembly 124 may include an inner rail 123, an outer rail 125, and a soft close mechanism 200. Additionally or alternatively, slide assembly 124 may include a trigger assembly 202 that includes a trigger support arm 204 and a trigger head 206. The trigger assembly 202 may be configured to interact with the soft close mechanism 200. For instance, the trigger assembly 202 may "trigger" or activate the soft close mechanism 200 by interacting with a saddle (e.g., as will be described in more detail below) of the soft close mechanism 200. Further additionally or alternatively, slide assembly 124 may include a mount assembly 231. In some embodiments, the inner rail 123 may be attached to the tub 104, and more particularly, may be attached directly to one of the side walls 128 of the tub 104. For instance, the inner rail 123 may be attached to the tub side wall 128 via any suitable fastener. For example, the inner rail 123 may be attached (e.g., directly) to the tub side wall 128 via rivets, bolts, screws, welds, etc.

In some embodiments, the inner rail 123 is extended between a first end 129 and a second end 131 approximately along the transverse direction T. Additionally, in some embodiments, the inner rail 123 includes a support slot 133 defined therethrough. The support slot may be positioned between the first end 129 and the second end 131. For example, the support slot 133 may be positioned approximately equidistance between the first end 129 and the second end 131. Further, in some embodiments, the inner rail 123 includes a flange 135. The flange 135 may protrude from the inner rail 123 approximately along the lateral direction L. Particularly, when the slide assembly 124 is attached to a lateral tub side wall 128 of the dishwashing appliance 100, the flange 135 may protrude towards the lateral tub side wall 128. Further, the flange 135 may be positioned between the support slot 133 and the second end 131 of the inner rail 123.

In some embodiments, the outer rail 125 extends between a first end 208 and a second end 213 approximately along the transverse direction T and may be slidably attached to the inner rail 123. When assembled, the slide assembly 124 may, thus, be capable of transitioning between the extended loading position and the retracted position. Additionally, in some embodiments, the outer rail 125 may include a plurality of slots 212 defined therethrough. Each slot of the plurality of slots 212 may extend approximately along the vertical direction V. Additionally, each slot of the plurality of slots 212 may be spaced apart approximately along the transverse direction T from adjacent slot(s) (e.g., in mutual parallel with each other). For instance, the plurality of slots 212 may be spaced apart between the first end 208 of the outer rail 125 and the second end 213 of the outer rail 125.

In some embodiments, for example, as illustrated in FIGS. 3 and 4, the slide assembly 124 also includes an intermediate rail 127. In some such embodiments, the outer rail 125 is slidably attached (e.g., directly) to the intermediate rail 127, which is slidably attached (e.g., directly) to the inner rail 123. In addition, the slide assembly 124 may include an inner cage 214 that may include a first set of ball bearings 216 and an outer cage 218. The outer cage 218 may include a second set of ball bearings 220.

When assembled, the inner cage 214 may be positioned between the intermediate rail 127 and the inner rail 123. The first set of ball bearings 216 may facilitate the movement of the intermediate rail 127 relative to the inner rail 123. In addition, the outer cage 218 may be positioned between the intermediate rail 127 and the outer rail 125. The second set of ball bearings 220 may facilitate the movement of the outer rail 125 relative to the intermediate rail 127. In this regard, during movement of the slide assembly 124, for example, when moving the slide assembly 124 between the extended loading position and the retracted position, the intermediate rail 127 may be capable of sliding along the inner rail 123 approximately along or parallel to the transverse direction T. Additionally or alternatively, the outer rail 125 may be capable of sliding along the intermediate rail 127 approximately along or parallel to the transverse direction T.

In some embodiments, the slide assembly 124 includes a soft close mechanism 200 to dampen movement of the slide assembly 124. More particularly, the soft close mechanism 200 may be provided to control, dampen, or quiet the movement of components, for instance, the intermediate rail 127 or the outer rail 125, during a retraction operation of the slide assembly 124. A retraction operation of the slide assembly 124 may be an operation of the slide assembly 124 wherein the slide assembly 124 may be retracted from the extended loading position to the retracted position such as when a user of the dishwashing appliance 100 may retract a rack assembly, such as the upper rack assembly 130.

Generally, the soft close mechanism 200 may be provided as any suitable soft close mechanism. In some embodiments, the soft close mechanism 200 is extended between a front end 256 and a rear end 270 (e.g., approximately along the transverse direction T or otherwise along the predefined direction of sliding movement). In some embodiments, the soft close mechanism 200 includes a saddle 224 and an actuator 226, for example, a spring, a damper, or a combination thereof, positioned within an actuator housing 228. The saddle 224 may include a front edge 223 and a rear edge 225 that may be spaced apart approximately along the transverse direction T.

Further, the saddle 224 may be coupled to the actuator 226 and may be configured as an intermediary component between the trigger assembly 202 and the actuator 226. For instance, during a retraction operation of the slide assembly 124, the trigger head 206 may interact with the saddle 224 to engage the actuator 226. The actuator 226 may be configured to dampen the movement of the outer rail 125 relative to the inner rail 123 such that a "soft close" of the slide assembly 124 may be achieved. Specifically, in some instances, the actuator 226 may include a spring and a damper. For example, during a retraction operation of the slide assembly 124, the spring, which may have been held in tension, may release potential energy (e.g., elastic potential energy) and the damper may create resistance for the spring during the retraction operation to slow down the movement of the slide assembly such that the "soft close" of the slide assembly 124 may be achieved.

Further, in some embodiments, the slide assembly 124 includes a mount assembly 231 that may be utilized to mount the soft close mechanism 200 to the outer rail 125. As illustrated in FIGS. 3 and 4, the mount assembly 231 may include an end cap 230 attached to the first end 208 of the outer rail 125, a second mount 232 attached to the outer rail 125, a first mount body 234, and a second mount body 236. Particularly, the soft close mechanism 200 may be mounted to the first mount body 234 and the second mount body 236 such that the soft close mechanism 200 is mounted to the outer rail 125. As used herein "mounted to" with regards to the soft close mechanism 200, the first mount body 234, and the second mount body 236 may refer to the soft close mechanism 200, or a portion thereof, being securely attached to or fixed to, such as or within, a portion of the first mount body 234, the second mount body 236, or a combination thereof.

It should be appreciated that the general orientation of the slide assembly 124 and the components thereof are provided by way of example only. For instance, in alternative exemplary embodiments, the slide assembly 124 may be oriented such that the soft close mechanism 200 and the trigger head 206 may be positioned atop of the slide assembly 124 approximately along the vertical direction V.

Figure 5:
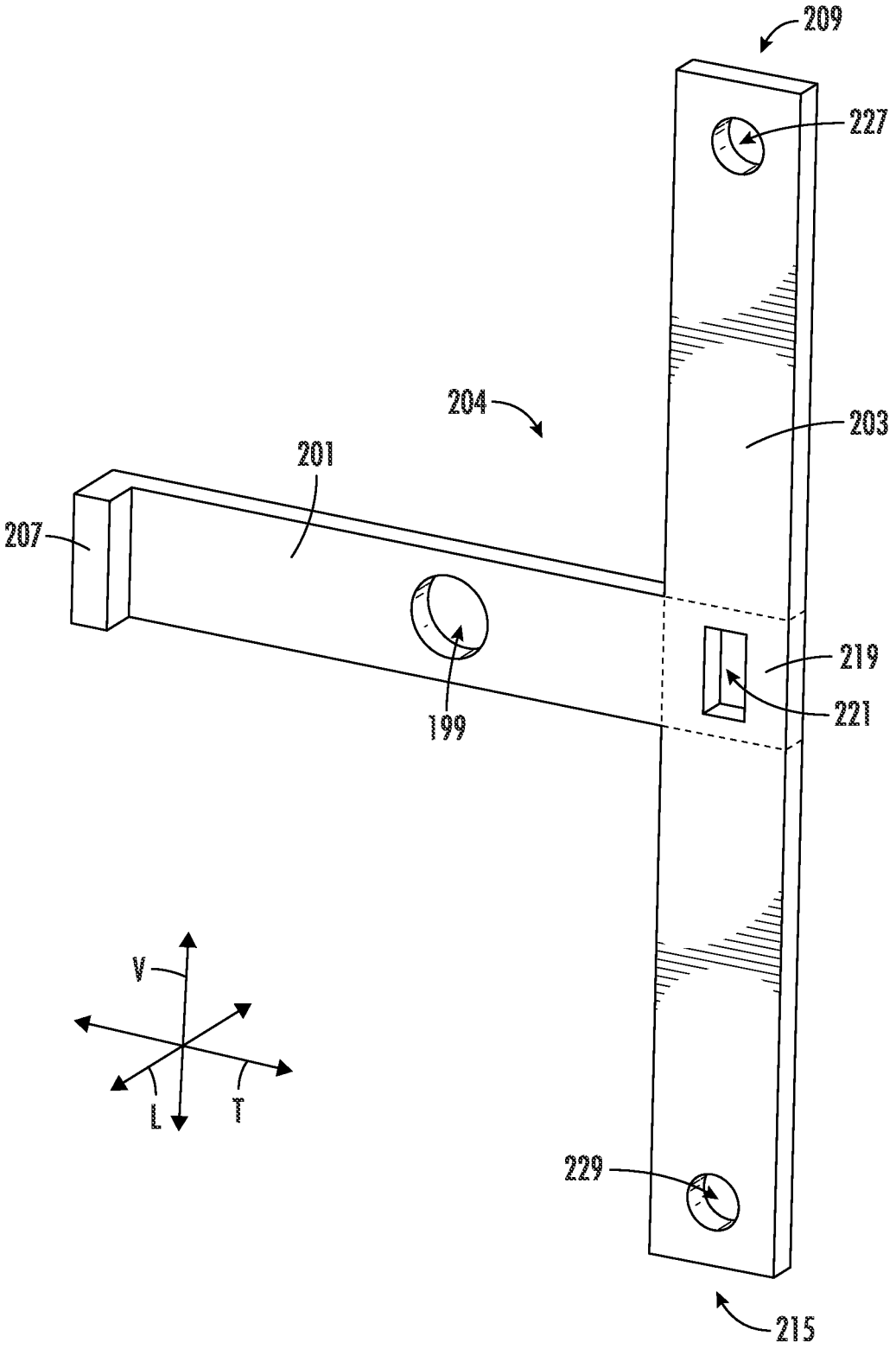
FIG. 5 provides a perspective view of a trigger support arm that may be incorporated into a slide assembly, such as the slide assembly of FIG. 3, according to one or more exemplary embodiments of the present subject matter.

Referring now to FIG. 5, a perspective view of the exemplary trigger support arm 204 according to one or more exemplary embodiments of the present subject matter is provided. As will be appreciated, the trigger support arm 204 may be utilized as a common component for the pair of slide assemblies 124. In other words, the same (or an identical) trigger support arm 204 may be utilized on both lateral sides of the dishwashing appliance 100. For instance, the trigger support arm 204 may be constructed such that the functionality of the trigger support arm 204 is maintained when the trigger support arm 204 is attached to either lateral tub side walls 128 of the dishwashing appliance 100. For example, the trigger support arm 204 may be symmetric about an axis, wherein the axis extends approximately along or parallel to the transverse direction T. In this regard, when trigger support arm 204 is flipped about the axis and attached to the opposing lateral tub side wall 128, the functionality of the trigger support arm is maintained. Additionally, as will be appreciated, the trigger support arm 204 may define locating features that assist in locating the trigger support arm 204 to the inner rail 123 of the slide assembly 124.

The trigger support arm 204 may generally include a first segment or member 201, a second segment or member 203, and a support tab 207. The second member 203 may define a first end 209 and a second end 215. The first end 209 and the second end 215 may be spaced apart approximately along the vertical direction V. In some embodiments, the second member 203 includes a center portion 219. The center portion 219 may be positioned approximately equidistance between the first end 209 and the second end 215. In other words, the center portion 219 may be positioned in the vertical center of the second member 203. Additionally, in some embodiments, the first member 201 is extended from the center portion 219 approximately along the transverse direction T. In this regard, the first member 201 and the second member 203 of trigger support arm 204 may generally form a "T" shape. The support tab 207 may be extended from the first end 209 of the first member 201 approximately along the lateral direction L.

It should be appreciated that the first member 201 may be attached (e.g., directly, or indirectly) to the second member 203. For instance, in some embodiments, the first member 201 and the second member 203 are a monolithic piece that is formed of any suitable material, for example, a rigid metal material. In this regard, in some embodiments, the center portion 219 may be formed, at least in part, by the first member 201.

In some embodiments, the second member may also include a slot 221 defined therethrough. In some embodiments, for example, as illustrated in FIG. 5, the slot 221 is defined through the center portion 219 of second member 203. During assembly, the trigger support arm 204 may be located to the slide assembly 124 via the slot 221. For instance, the trigger support arm 204 may be located to the slide assembly 124, and more particularly, the inner rail 123 of the slide assembly 124, via the flange 135 engaging with the slot 221. In this regard, the flange 135 and the slot 221 may together assist an operator in positioning the trigger support arm 204 to the inner rail 123 of the slide assembly 124 during the assembly. The assembly location of the trigger support arm 204 may be a relatively inaccessible or may be a low visibility location within the dishwashing appliance 100. In this regard, the slot 221 may aid the assembly process by confirming, e.g., to an operator, the proper location of the trigger support arm 204, e.g., relative to the inner rail 123.

Additionally, in some embodiments, the second member 203 includes a first hole 227 defined therethrough and a second hole 229 defined therethrough. The first hole 227 may be positioned at or proximate to the first end 209. As used herein "proximate to the first end 209" may generally refer to the first hole 227 being positioned closer to the first end 209 than the second end 215. Additionally, the first hole 227 may be positioned between the center portion 219 and the first end 209.

The second hole 229 may be positioned at or proximate to the second end 215. As used herein "proximate to the second end 215" may generally refer to the second hold 229 being positioned closer to the second end 215 than the first end 209. Additionally, the second hole 229 may be positioned between the center portion 219 and the second end 215. As will be described in more detail below, the first hole 227 or the second hole 229 may be configured to engage with the trigger head 206 such that the trigger head 206 may be attached to the trigger support arm 204.

Additionally, the trigger support arm 204 may include a fastener hole 199 defined through the first member 201. In some embodiments, the fastener hole 199 may be configured to receive a fastener or may be utilized as a fastening location, e.g., a welding location. For instance, the fastener hole 199 may be utilized to attach (e.g., utilizing any suitable fastener such as a bolt, screw, rivet, weld, etc.) the trigger support arm 204 to the inner rail 123 of the slide assembly 124.

In some embodiments, the support tab 207 may also be used to locate the trigger support arm 204 to the inner rail 123. For instance, the support tab 207 may be positioned within the support slot 133 defined through the inner rail 123. The direction of the extension of the support tab 207 (e.g., approximately along the lateral direction L) may correspond to a lateral side of the dishwashing appliance 100 that the slide assembly 124 may be attached to. For instance, the direction of the extension of the support tab 207 may be configured such that the support tab 207 may extend approximately along the lateral direction L toward the center of the tub 104 (e.g., when the slide assembly 124 may be attached to a lateral tub side wall 128 of the tub 104). In this regard, the trigger support arm 204 may be utilized on either lateral side of the tub 104.

Figure 6:
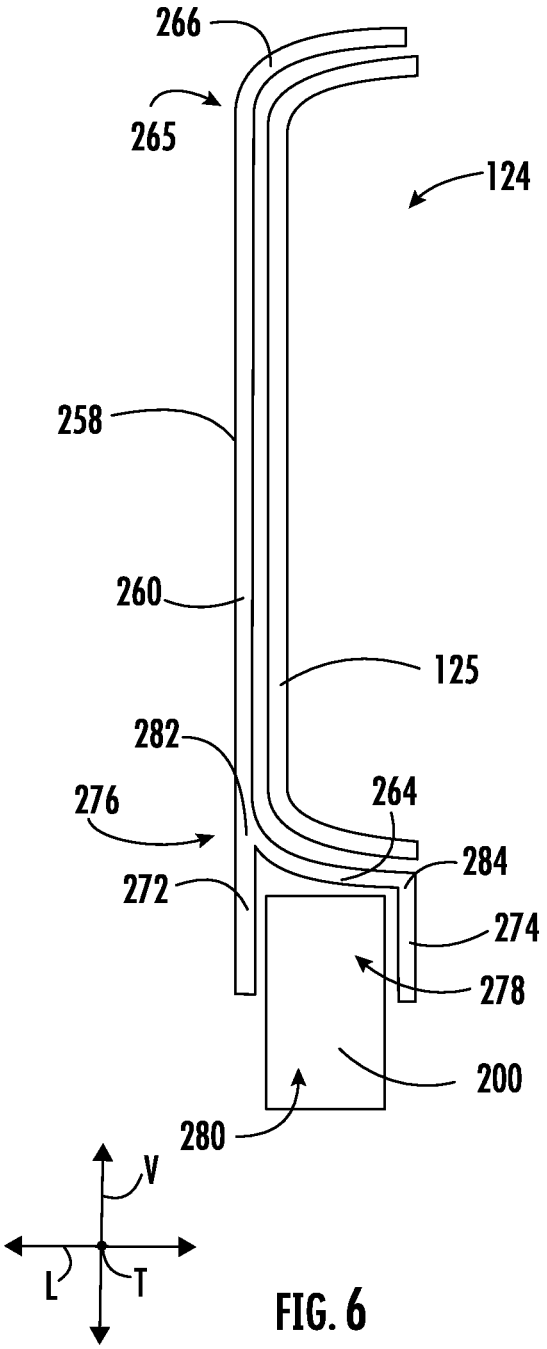
FIG. 6 provides a simplified cross-sectional view of the exemplary slide assembly of FIG. 3.

Referring now to FIG. 6, a simplified cross-sectional view of the slide assembly 124 according to one or more exemplary embodiments of the present subject matter is provided. Specifically, FIG. 6 depicts a simplified cross-sectional view of the slide assembly 124 in a vertical orientation. In some embodiments, the second mount body 236 may include a first wall 272 and a second wall 274. For instance, the first wall 272 may extend from or be in line with, the first edge 276 of the mount wall 260 of the second mount 232. In this regard, the first wall 272 may be extended approximately along the vertical direction V from the mount wall 260.

In some embodiments, the first wall 272 and the second wall 274 define the housing cavity 268 that the soft close mechanism 200 may be mounted within. For instance, in some embodiments, the soft close mechanism 200 may include a first portion 278 and a second portion 280. The first portion 278 of the soft close mechanism 200 may be mounted entirely within the housing cavity 268 and the second portion 280 may be positioned outside of the housing cavity 268. In this regard, the first portion 278 of the soft close mechanism 200 may be the only portion of the soft close mechanism 200 that is mounted within the second mount body 236.

Particularly, the first portion 278 of the soft close mechanism 200 may correspond to a portion of the soft close mechanism 200 that may be used to mount or attach the soft close mechanism 200 to the first mount body 234, the second mount body 236, or a combination thereof. Further, the second portion 280 of the soft close mechanism 200 may correspond to the actuation components of the soft close mechanism 200, for example, the saddle 224 or the actuator 226, that may interact with, or may be influenced by, the trigger assembly 202 during operation of the slide assembly 124, for instance, during a retraction operation of the slide assembly 124.

As illustrated in FIG. 6, the second mount body 236 may be positioned in a vertical orientation. In the vertical orientation, the second mount body 236 and components thereof extend generally along the vertical direction V. In this regard, the second mount body 236 may define an opening, e.g., the housing cavity 268, that faces toward or along the vertical direction V. Further, the orientation of the second mount body 236 may determine the orientation of the soft close mechanism 200. For instance, when the second mount body 236 is in the vertical orientation, the soft close mechanism 200 may be mounted within the second mount body 236 in a vertical orientation, e.g., the soft close mechanism 200 may also extend generally along the vertical direction V.

For instance, in the vertical orientation, the first portion 278 and the second portion 280 of the soft close mechanism 200 are positioned adjacent to each other approximately along the vertical direction V. In other words, the first portion 278 and the second portion 280 of the soft close mechanism 200 may be stacked atop one another such that the soft close mechanism 200 is orientated vertically. For example, as illustrated in FIG. 6, the second portion 280 of the soft close mechanism 200 may be positioned atop the first portion 278 of the soft close mechanism 200 approximately along the vertical direction V.

In some embodiments, the second lip is attached to the second edge 265 of the mount wall 260. The first lip 264 of the main body 258 may include a proximal end 282 that may be attached to the first edge 276 of the mount wall 260. In addition, the first lip 264 of the main body 258 may include a distal end 284. Further, in the vertical orientation, the second wall 274 of the second mount body 236 may be extended from the distal end 284 of the first lip 264 approximately along the vertical direction V. For instance, the second wall 274 of the second mount body 236 may be extended such that the second wall 274 is approximately parallel to the first wall 272. In this regard, the second mount body 236 and the housing cavity 268 defined by the second mount body 236 may be in the vertical orientation.

Figure 7:
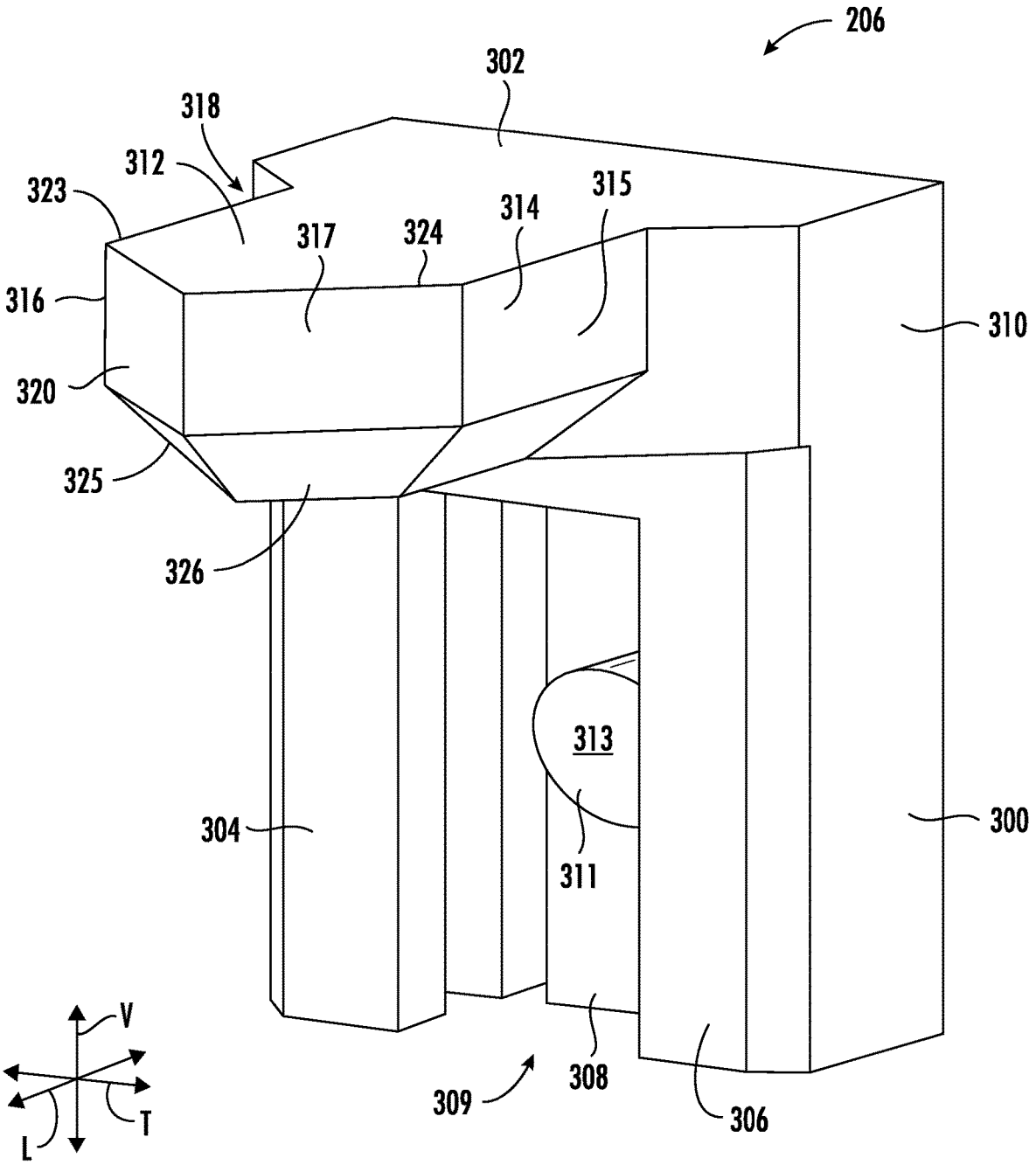
FIG. 7 provides a perspective view of a trigger head of the exemplary slide assembly of FIG. 3.
Figure 8:
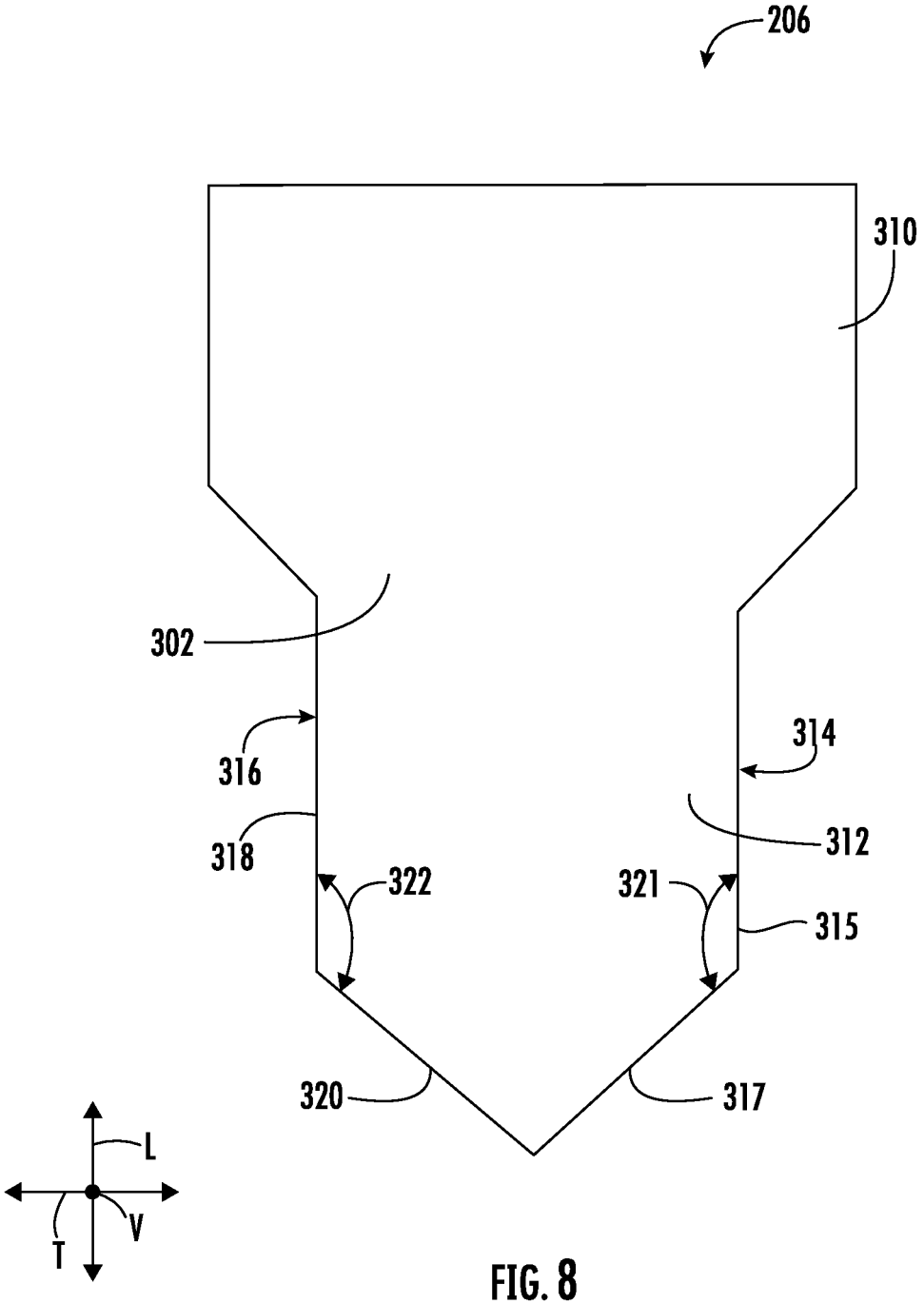
FIG. 8 provides a top view of the exemplary trigger head of FIG. 7.
Figure 9:
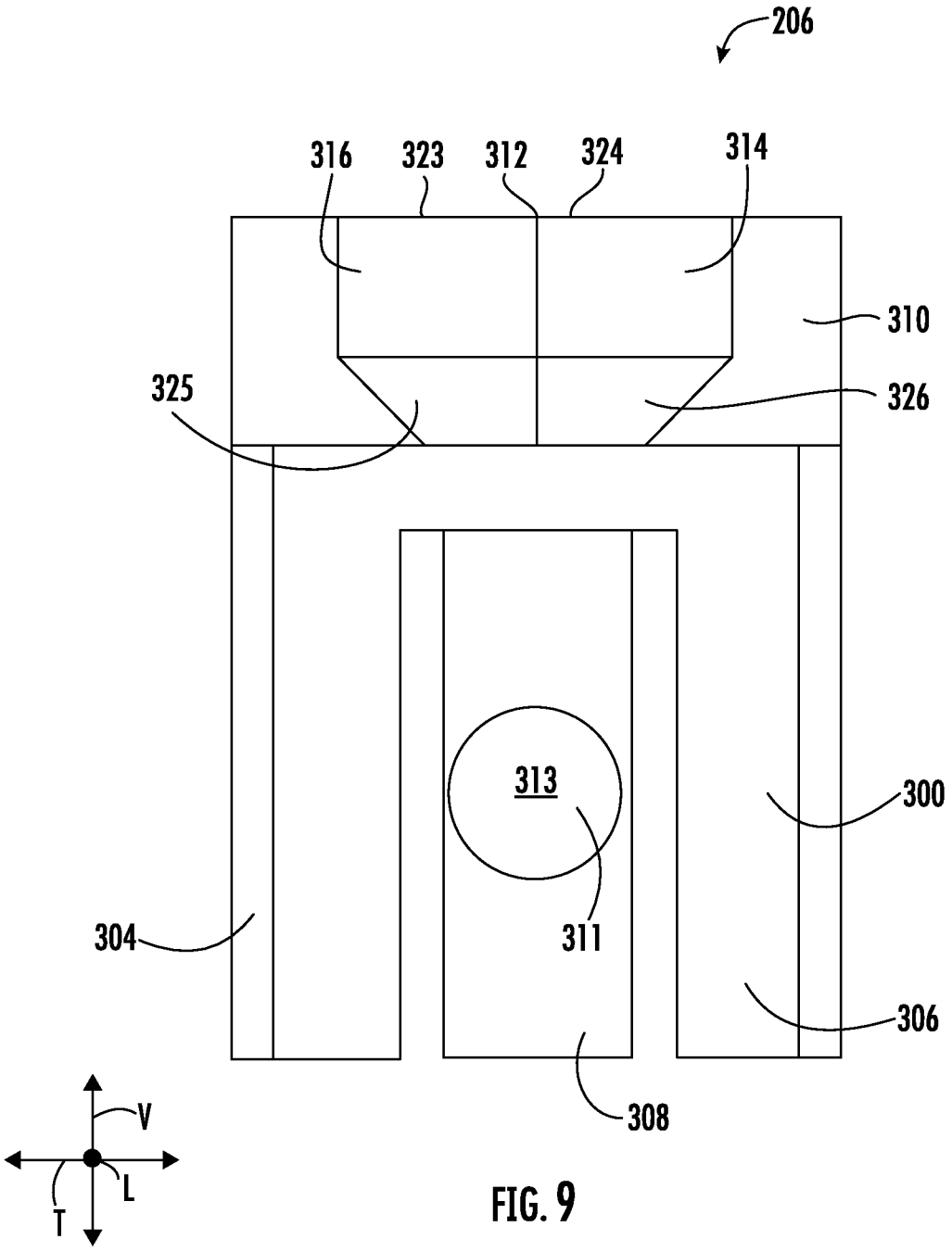
FIG. 9 provides a front view of the exemplary trigger head of FIG. 7.
Figure 10:
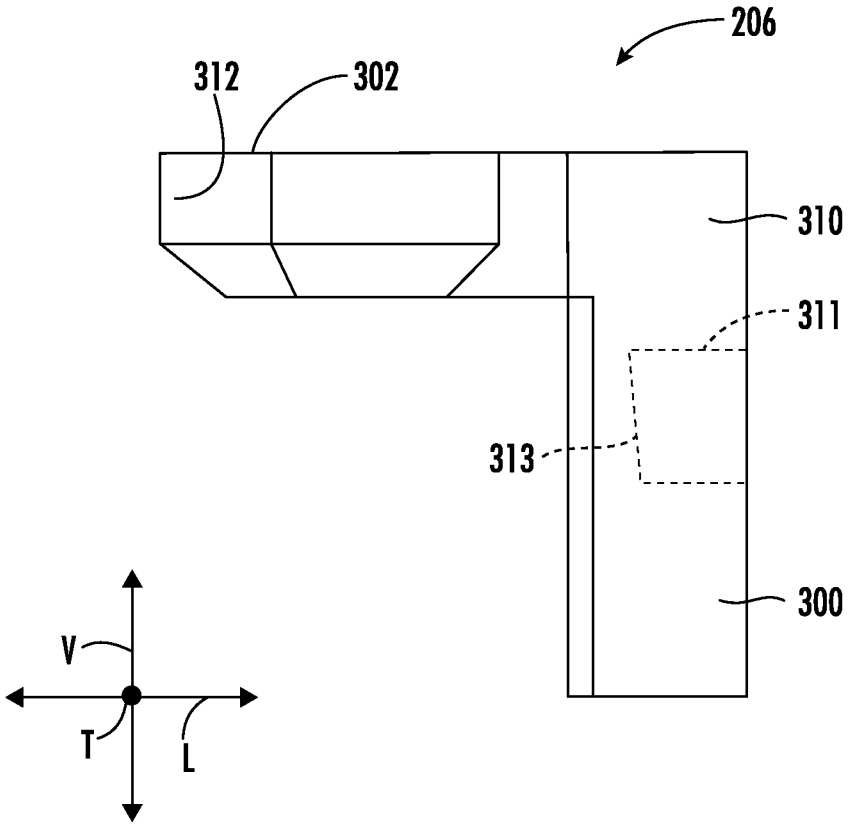
FIG. 10 provides a side view of the exemplary trigger head of FIG. 7.

Referring now to FIGS. 7 through 10, exemplary embodiments of the trigger head 206 of the exemplary slide assembly 124 are provided according to one or more exemplary embodiments of the present subject matter. Specifically, FIG. 7 illustrates a perspective view of the trigger head 206, FIG. 8 illustrates a top view of the trigger head 206, FIG. 9 illustrates a front view of the trigger head 206, and FIG. 10 illustrates a side view of the trigger head 206. As will be appreciated, the trigger head 206 may be configured to engage with a soft close mechanism (e.g., in a vertical orientation). For instance, the trigger head 206 may be configured to engage with the soft close mechanism 200 in the vertical orientation as illustrated in FIG. 6.

In some embodiments, the trigger head 206 generally includes a base 300 and a top 302. The base 300 may generally be configured to attach the trigger head 206 to the trigger support arm 204. For instance, the base 300 may define a slot 309 that the trigger support arm 204 may be attached within. Particularly, a first leg 304, a second leg 306, and an arm 308 of the base 300 may define the slot 309. In some embodiments, the first leg 304, the second leg 306, and the arm 308 each extend approximately along the vertical direction V. Further, the first leg 304 and the second leg 306 may be spaced apart approximately along the transverse direction T. For example, the first leg 304 may be positioned at a first transverse side of the base 300 and the second leg 306 may be positioned at a second transverse side of the base 300. In addition, the arm 308 may be positioned between the first leg 304 and the second leg 306 (e.g., approximately along the transverse direction T).

The arm 308 may be positioned at a lateral end of the base 300. Thus, the first leg 304, the second leg 306, and the arm 308 may generally define the slot 309 therebetween. Further, in some embodiments, the arm 308 includes a pin 311 that may be extended approximately along the lateral direction L. In some embodiments, the pin 311 is tapered approximately along the vertical direction V. For instance, a face 313 of the pin 311 may be sloped such that the taper may be formed.

In some embodiments, the trigger head 206 is attached to the second member 203 of the trigger support arm 204. Specifically, the trigger head 206 may be attached to the second member 203 within the slot 309. In some embodiments, the trigger head 206 is attached to the second member 203 within the slot 309 via the pin 311 engaging with the first hole 227 or the second hole 229. For instance, in some embodiments, the trigger head 206 is attached to the first end 209 of the second member 203. In such embodiments, the pin 311 may be engaged with, e.g., inserted into, the first hole 227 of the second member 203 such that the trigger head 206 is attached, e.g., secured, to the trigger support arm 204.

In some other embodiments, the trigger head 206 is attached to the second end 215 of the second member 203. In some such embodiments, the pin 311 may be engaged with, e.g., inserted into, the second hole 229 of the second member 203 such that the trigger head 206 is attached, e.g., secured, to the trigger support arm 204.

During assembly of the trigger assembly 202, the trigger head 206 may be positioned on the first end 209 or the second end 215 of the second member 203 and moved along the vertical direction V, e.g., relative to the second member 203. As the trigger head 206 is moved along the vertical direction V, the sloped face 313 of the pin 311 may interface with the second member 203. As the sloped face 313 interfaces with the second member 203, the arm 308 may deflect approximately along the lateral direction L. Further, once the pin 311 is fully inserted into the first hole 227 or the second hole 229, the arm 308 may return to its original undeflected position (e.g., as it may be biased to the undeflected position). In this regard, the pin 311 may be configured to secure the trigger head 206 to the trigger support arm 206.

Additionally, the top 302 may be attached (e.g., directly, or indirectly) to the base 300. For instance, in some embodiments, the base 300 and the top 302 are a monolithic piece that is formed of any suitable material, for example, a rigid polymer material. The top 302 may generally be configured to interact with the soft close mechanism 200. Additionally, the top 302 may include a main body 310 and a tip 312. The tip 312 may be extended from the main body 310 approximately along the lateral direction L. The extension of the tip 312 may allow the trigger head 206 to engage with, e.g., contact, a soft close mechanism 200 in a vertical orientation. For instance, the extension of the tip 312 may allow the trigger head 206 to engage with a saddle, such as the saddle 224 of the soft close mechanism 200 when the soft close mechanism 200 is in a vertical orientation.

In some embodiments, the top 302, and more particularly, the tip 312 includes an angled leading side 314 and an angled trailing side 316. The angled leading side 314 and the angled trailing side 316 may be spaced apart, at least in part, approximately along the transverse direction T. The angled leading side 314 may include a first leading portion 315 and a second leading portion 317. The first leading portion 315 and the second leading portion 317 may define a first predetermined angle 321 therebetween. In some embodiments, the first leading portion 315 is extended along or approximately parallel to the lateral direction L and the second leading portion 317 is extended from the first leading portion 315 at the first predetermined angle 321. The first predetermined angle 321 may be any suitable angle (e.g., greater than 0°) that may form the angled leading side 314. For instance, in some embodiments (e.g., as illustrated in FIGS. 7 through 10), the first predetermined angle 321 is an obtuse angle (e.g., an angle which is greater than ninety degrees) (90° and less than one hundred eighty degrees (180°)).

The angled leading side 314 may include a first leading edge 324 and a second leading edge 326. The first leading edge 324 and the second leading edge 326 may be spaced apart approximately along the vertical direction V. In some embodiments, the second leading edge 326 is chamfered. For instance, the second leading edge 326 may be angled or beveled such that a sloping surface is formed. Thus, in some embodiments, the second leading edge 326 is referred to as a chamfered leading edge 326.

The angled trailing side 316 may include a first trailing portion 318 and a second trailing portion 320. The first trailing portion 318 and the second trailing portion 320 may define a second predetermined angle 322 therebetween. In some embodiments, the first trailing portion 318 is extended along or approximately parallel to the lateral direction L and the second trailing portion 320 is extended from the first trailing portion 318 at the second predetermined angle 322. The second predetermined angle 322 may be any suitable angle (e.g., greater than 0°) that may form the angled trailing side 316. For instance, in some embodiments (e.g., as illustrated in FIGS. 7 through 10), the second predetermined angle 322 is an obtuse angle (e.g., an angle which is greater than ninety degrees (90°) and less than one hundred eighty degrees (180°)).

The angled trailing side 316 may include a first trailing edge 323 and a second trailing edge 325. The first trailing edge 323 and the second trailing edge 325 may be spaced apart approximately along the vertical direction V. In some embodiments, the second trailing edge 325 is chamfered. For instance, the second trailing edge 325 may be angled or beveled such that a sloping surface is formed. Thus, in some embodiments, the second leading edge 326 is referred to as a chamfered leading edge 326.

In some embodiments, the first predetermined angle 321 and the second predetermined angle 322 may be equivalent such that the tip 312 may be symmetric (e.g., approximately along the transverse direction T). In this regard, the trigger head 206 may advantageously be utilized on either lateral end of the tub 104.

The angled leading side 314 of the trigger head 206 may advantageously help facilitate resetting of the slide assembly 124 following a false trip failure mode of the slide assembly 124, and more particularly, the soft close mechanism 200. A "false trip failure mode" may refer to a failure mode of the soft close mechanism 200 wherein the actuator 226 of the soft close mechanism 200 may unintentionally be triggered, e.g., activated. For instance, the soft close mechanism 200 may be triggered, e.g., activated, by a source other than the trigger head 206. For example, articles within the rack assembly or a user may unintentionally strike, and thereby, trigger the soft close mechanism 200. This unintentionally triggering of the soft close mechanism 200 may prevent the slide assembly 124 from completely closing, e.g., being fully retracted.

In order to reset the slide assembly 124 following a false trip failure mode, the slide assembly 124 may be manually closed, e.g., manually moved or pushed toward the retracted position. In this regard, the angled leading side 314 of the trigger head 206 may engage, or contact, the rear edge 225 of the saddle 224. Specifically, the sloped surfaces created by the angled leading side 314, e.g., sloped surface created by the first leading portion 315 and the second leading portion 317 and the sloped surface of the chamfered second leading edge 326, may deflect the saddle 224 when the trigger head 206 is engaged with, or has contacted, the rear edge 225 of the saddle 224. Thus, the angled leading side 314 may allow the slide assembly to be reset, e.g., returned to a position wherein the trigger head 206 is positioned within the saddle 224, following a false trip failure mode of the soft close mechanism 200.

The angled trailing side 316 of the trigger head 206 may advantageously help facilitate resetting of the slide assembly 124 following a skipping failure mode of the slide assembly 124, and more particularly, the soft close mechanism 200. A "skipping failure mode" may refer to a failure mode of the soft close mechanism 200 wherein the trigger head 206 may "skip" or slide past (e.g., approximately along the transverse direction T) the rear edge 225 of the saddle 224 during a retraction operation of the soft close mechanism 200. For instance, the slide assembly 124 may be moved, e.g., pushed, into the retracted position with sufficient enough force that the trigger head 206 may skip, thus causing a skipping failure mode to occur.

In order to reset the slide assembly 124 following a skipping failure mode, the slide assembly 124 may be opened, e.g., moved toward the fully extended position. In this regard, the angled trailing side 316 of the trigger head 206 may engage, or contact, the rear edge 225 of the saddle 224. Specifically, the sloped surfaces created by the angled trailing side 316, e.g., sloped surface created by the first trailing portion 318 and the second trailing portion 320 and the sloped surface of the chamfered second trailing edge 325, may deflect the saddle 224 when the trigger head 206 is engaged with, or has contacted, the rear edge 225 of the saddle 224. Thus, the angled trailing side 316 may allow the slide assembly to be reset, e.g., returned to a position wherein the trigger head 206 is positioned within the saddle 224, following a skipping failure mode of the soft close mechanism 200.

Figure 11:
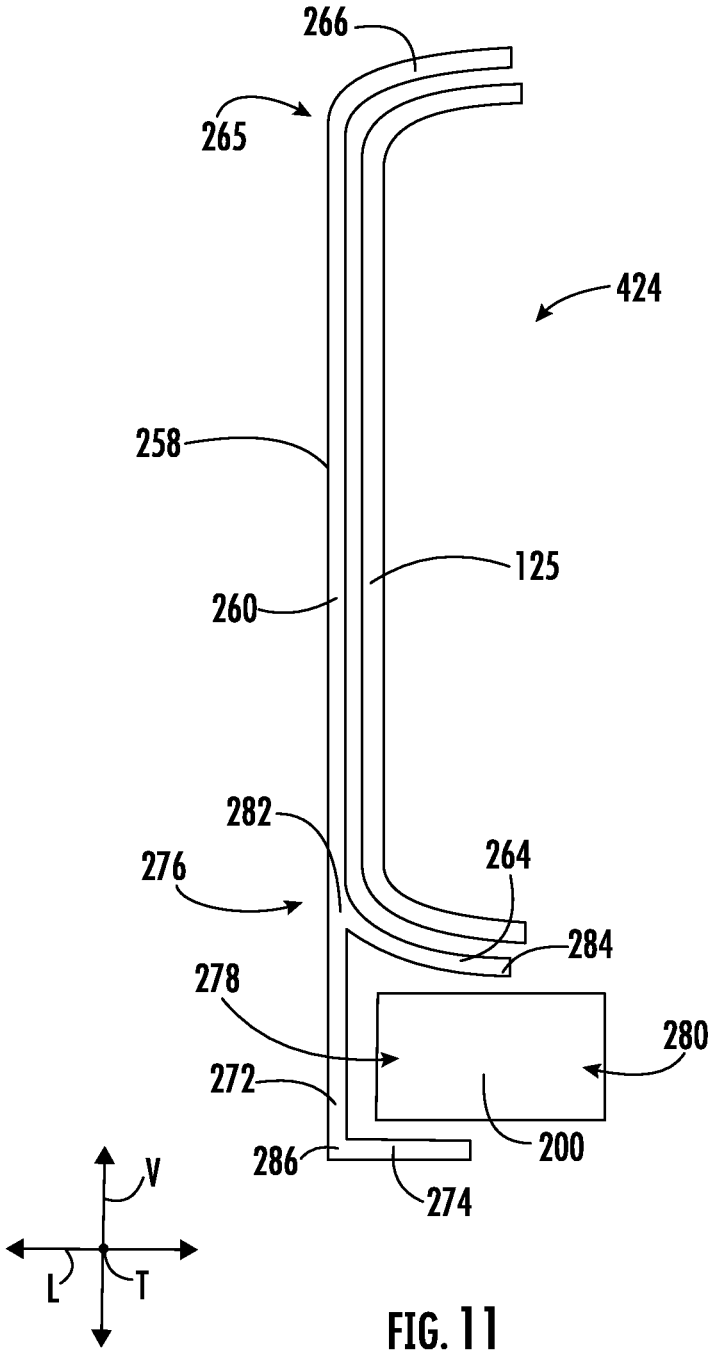
FIG. 11 provides a simplified cross-sectional view of an alternative slide assembly according to one or more exemplary embodiments of the present subject matter.

Referring now to FIG. 11, a simplified cross-sectional view of a slide assembly 424 in accordance with another exemplary embodiment of the present subject matter is provided. The exemplary slide assembly 424 of FIG. 11 may be configured in substantially the same manner as the exemplary slide assembly 124 of FIG. 6, and accordingly, the same or similar numbers may refer to the same or similar parts.

For example, the exemplary slide assembly 424 of FIG. 11 generally includes a mount assembly 231 that may include a second mount 232 attached to an outer rail 125. The second mount 232 may include a main body 258 that may include a mount wall 260, a first lip 264 attached to a first edge of the mount wall 260, and a second lip 266 attached to a second edge of the mount wall 260. The mount assembly 231 may also include a first wall 272 that may include a proximal end 282 attached to the first edge 276 of the mount wall 260 and a distal end 284. However, for the embodiment of FIG. 11, the second mount body 236 may be in a horizontal orientation. Particularly, the second wall 274 of the second mount body 236 may be extended from the distal end 284 of the first wall 272 approximately along the lateral direction L, for instance, such that the second wall 274 is positioned approximately perpendicularly to the first wall 272. In this regard, the horizontal orientation of the second mount body 236 may be formed.

As illustrated in FIG. 11, the soft close mechanism 200 may be mounted within the second mount body 236 in a horizontal orientation. In the horizontal orientation, the second mount body 236 and components thereof may extend generally along the lateral direction L. In this regard, the second mount body 236 may define an opening, e.g., the housing cavity 268, that faces toward or along the lateral direction L. Further, the orientation of the second mount body 236 may determine the orientation of the soft close mechanism 200. For instance, when the second mount body 236 is in a horizontal orientation, the soft close mechanism 200 may be mounted within the second mount body 236 in a horizontal orientation, e.g., the soft close mechanism 200 may also extend generally along the lateral direction L.

For instance, in the horizontal orientation the first portion 278 and the second portion 280 of the soft close mechanism 200 are positioned adjacent to each other approximately along the lateral direction L. In other words, the first portion 278 and the second portion 280 of the soft close mechanism 200 may be positioned side by side such that the soft close mechanism 200 is orientated horizontally. The horizontal orientation of the second mount body 236 may be utilized to accommodate different styles and orientations of triggers, such as the trigger assembly 202, and more particularly trigger heads, such as the trigger head 206.

Figure 12:
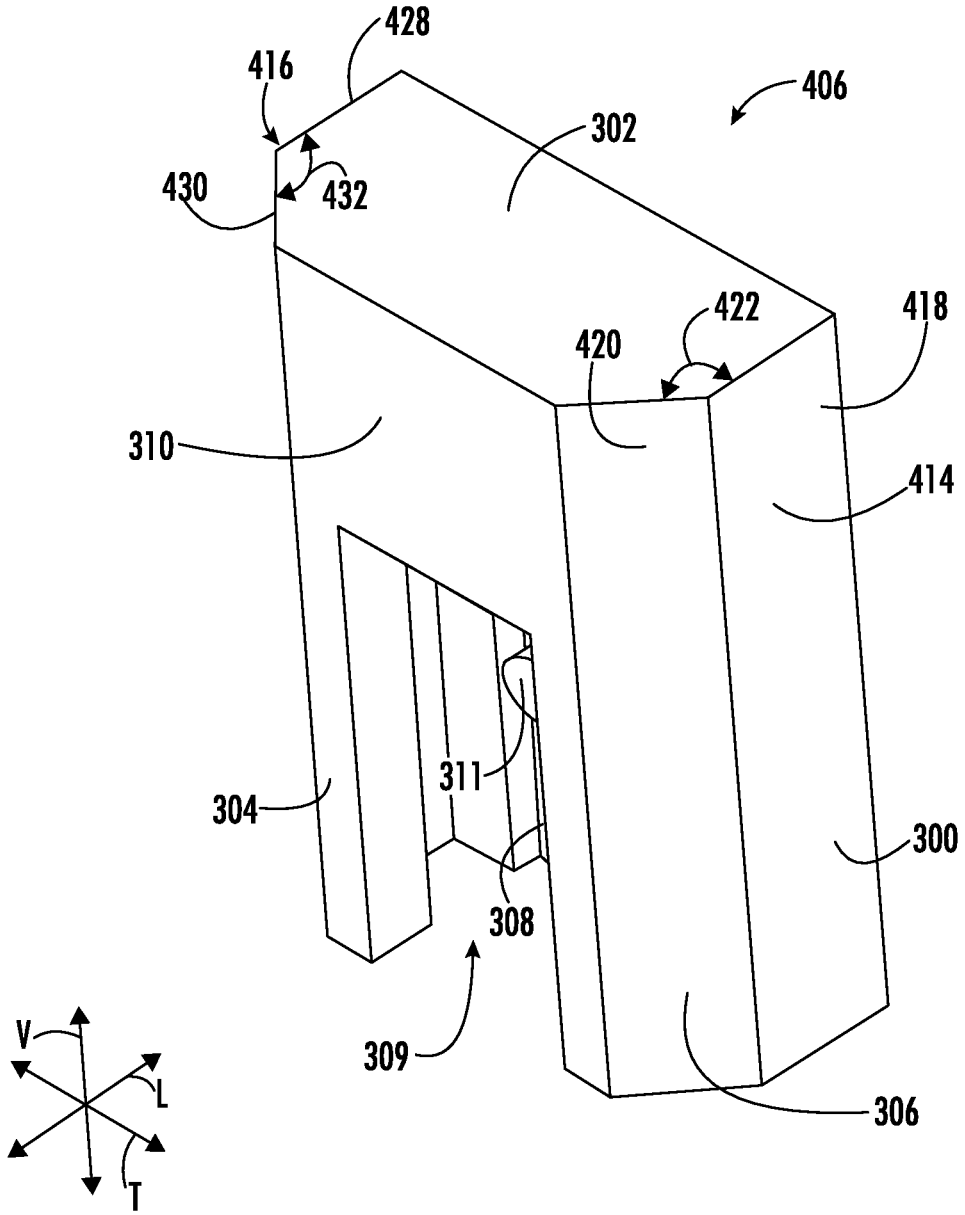
FIG. 12 provides a perspective view of an alternative trigger head that may be incorporated into a slide assembly, such as the slide assembly of FIG. 11, according to one or more exemplary embodiments of the present subject matter.

Referring now to FIG. 12, a perspective view of a trigger head 406 in accordance with another exemplary embodiment of the present disclosure is provided. The exemplary trigger head 406 may be configured in substantially the same manner as the exemplary trigger head 206 of FIGS. 7 through 10, and accordingly, the same or similar numbers may refer to the same or similar parts.

For example, the exemplary trigger head 406 of FIG. 12 generally includes a base 300 and a top 302. The base 300 may generally be configured to attach the trigger head 206 to the trigger support arm 204. For instance, the base 300 may define a slot 309 that the trigger support arm 204 may be attached within. Particularly, a first leg 304, a second leg 306, and an arm 308 of the base 300 may define the slot 309. In some embodiments, the first leg 304, the second leg 306, and the arm 308 each extend approximately along the vertical direction V. Further, the first leg 304 and the second leg 306 may be spaced apart approximately along the transverse direction T. For example, the first leg 304 may be positioned at a first transverse side of the base 300 and the second leg may be positioned at a second transverse side of the base 300. In addition, the arm 308 may be positioned between the first leg 304 and the second leg 306 (e.g., approximately along the transverse direction T). The arm 308 may be positioned at a lateral end of the base 300. Thus, the first leg 304, the second leg 306, and the arm 308 may generally define the slot 309 therebetween.

Further, in some embodiments, the arm 308 includes a pin 311 that may be extended approximately along the lateral direction L. The pin 311 may be inserted into a second hole 205 defined through the trigger support arm 204. Thus, the trigger head 206 may be attached, e.g., secured, to the trigger support arm 204 within the slot 309.

Additionally, the top 302 may be attached (e.g., directly or indirectly) to the base 300. For instance, in some embodiments, the base 300 and the top 302 are a monolithic piece that is formed of any suitable material, for example, a rigid polymer material. The top 302 may generally be configured to interact with the soft close mechanism 200. Additionally, the top 302 may include a main body 310. However, for the embodiment of FIG. 12, the top 302 does not include a tip. Rather, the main body 310 may include, at least in part, an angled leading side 414 and the angled trailing side 416. The angled leading side 414 and the angled trailing side 416 may be spaced apart approximately along the transverse direction T. In this regard, the trigger head 406 may be configured to engage with a soft close mechanism that may be in a horizontal orientation. For instance, the trigger head 406 may be configured to engage with the soft close mechanism 200 in the horizontal orientation as illustrated in FIG. 11.

The angled leading side 414 may include a first leading portion 418 and a second leading portion 420. The first leading portion 418 of the angled leading side 414 and the second leading portion 420 of the angled leading side 414 may define a predetermined angle 422 therebetween. In some embodiments, the first leading portion 418 of the angled leading side 414 is extended along or approximately parallel to the lateral direction L. Additionally, in some embodiments, the second leading portion 420 of the angled leading side 414 is extended from the first leading portion 418 at the predetermined angle 422. The predetermined angle 422 may be any suitable angle (e.g., greater than 0°) that may form the angle trailing side 316. For instance, in some embodiments, e.g., FIG. 12, the predetermined angle 422 is an obtuse angle (e.g., an angle which is greater than ninety degrees (90°)and less than one hundred eighty degrees (180°)).

Additionally, the angled trailing side 416 may include a first portion 428 and a second portion 430. The first portion 428 of the angled trailing side 416 and the second portion 430 of the angled trailing side 416 may define a predetermined angle 432 therebetween. In some embodiments, the first portion 428 of the angled trailing side 416 is extended along or approximately parallel to the lateral direction L. Additionally, in some embodiments, the second portion 430 of the angled trailing side 416 is extended from the first portion 428 at the predetermined angle 432. The predetermined angle 432 may be any suitable angle that may form the angled trailing side 416. For instance, in some embodiments e.g., FIG. 12, the predetermined angle 432 is an obtuse angle (e.g., an angle which is greater than ninety degrees (90°) and less than one hundred eighty degrees (180°)).

Figure 13:
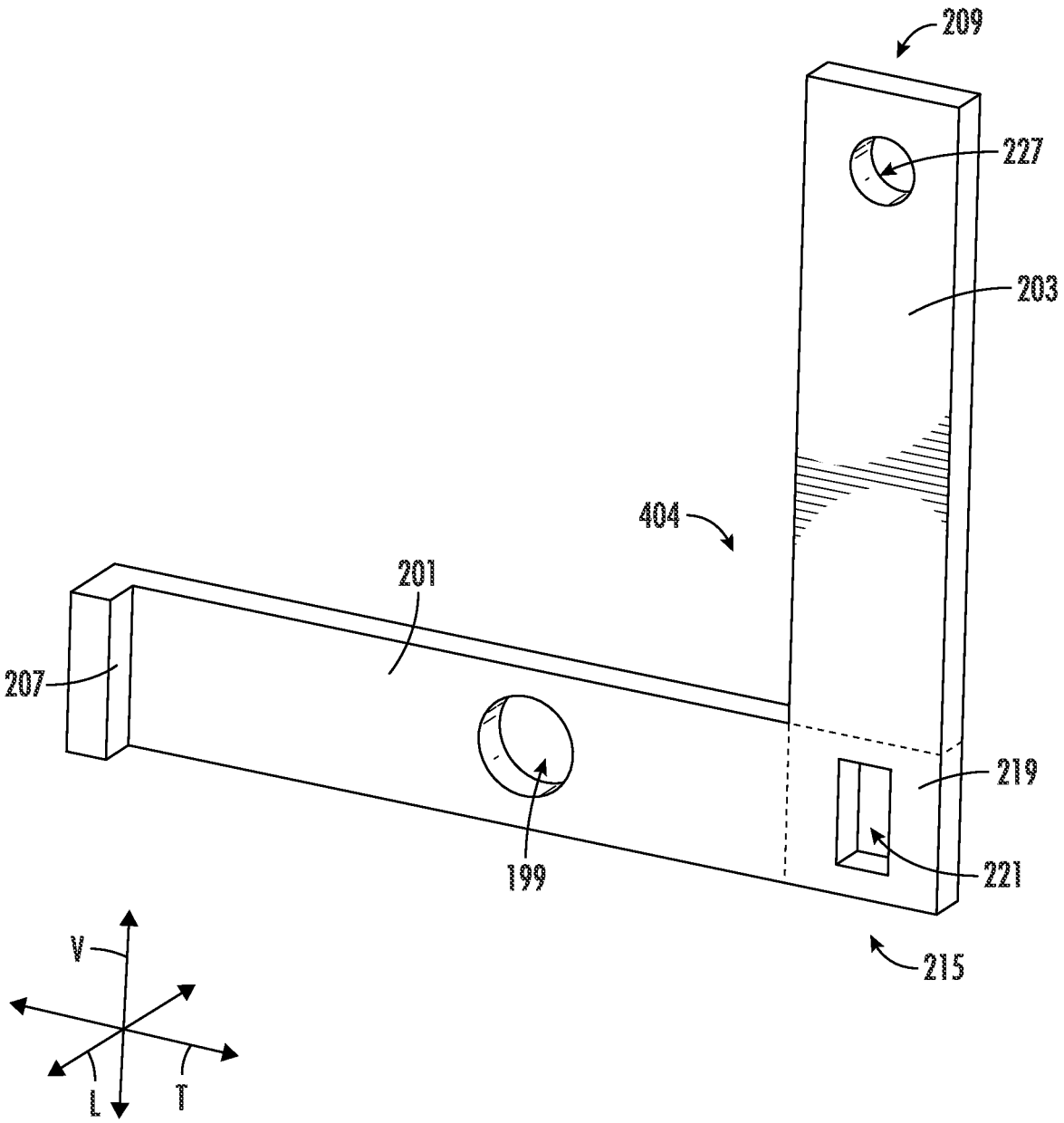
FIG. 13 provides a perspective view of an alternative trigger support arm that may be incorporated into a slide assembly, such as the slide assembly of FIG. 3, according to one or more exemplary embodiments of the present subject matter.

Referring now to FIG. 13, a perspective view of an exemplary trigger support arm 404 according to one or more exemplary embodiments of the present subject matter is provided. The exemplary trigger support arm 404 of FIG. 13 may be configured in substantially the same manner as the exemplary trigger support arm 204 of FIG. 5, and accordingly, the same or similar numbers may refer to the same or similar parts.

For example, the exemplary trigger support arm 404 of FIG. 13 generally includes a first segment or member 201, a second segment or member 203, and a support tab 207. The trigger support arm 404 may include a fastener hole 199 defined through the first member 201. The second member 203 may define a first end 209 and a second end 215 spaced apart approximately along the vertical direction V. The trigger support arm 404 may also include a first hole 227 defined therethrough. The first hole 227 may be positioned at or proximate to the first end 209. In some embodiments, the second member 203 may also include a slot 221 defined therethrough.

However, for the embodiment of FIG. 13, the second member may include an end portion 419 positioned at or proximate to the second end 215 of the second member 203. Additionally, in some embodiments, the first member 201 is extended from the end portion 419 of the second member 203 approximately along the transverse direction T. In this regard, the first member 201 and the second member 203 of FIG. 13 may generally form an "L" shape. In some embodiments, the slot 221 is defined through the end portion 419.

It should be appreciated that the lateral extension of the support tab 207 is provided by way of example only. In additional or alternative exemplary embodiments, the support tab 207 may be extended in a direction, e.g., approximately along the lateral direction L, opposite to the illustrated direction. In this regard, the trigger support arm 404 may be attached to slide assemblies 124 positioned at either lateral side of the dishwashing appliance 100.

Embodiments of the present subject matter advantageously provide a trigger assembly that includes a trigger support arm having a locating slot. For instance, the locating slot of the trigger support arm can aid in locating the trigger support arm to the inner rail of the slide assembly. Additionally, the trigger support arm may advantageously be symmetrical. In this regard, the trigger support arm may be utilized on a slide assembly attached to either lateral side of the dishwashing appliance. For example, the trigger support arm may be "T" or "L" shaped and may be attached to either lateral tub side wall of the dishwashing appliance, e.g., via a permanent or a temporary fastener. Further, embodiments of the present subject matter advantageously include a flange that may protrude from the inner rail of the slide assembly. The flange may engage with the slot to locate the trigger support arm to the inner rail. Additionally, the flange may constrain the trigger support arm to the slide assembly. For example, the flange can restrict translation or rotation of the trigger support arm relative to the slide assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a vertical direction, a lateral direction, and a transverse direction, the dishwashing appliance comprising:

a tub defining a wash chamber;

a rack assembly positioned within the wash chamber;

a slide assembly mounted to the tub, the slide assembly comprising a soft close mechanism, the soft close mechanism comprising an actuator to dampen movement of the slide assembly, and wherein the rack assembly is slidably mounted to the slide assembly to transition the rack assembly between an extended loading position and a retracted position; and a trigger assembly comprising a trigger support arm, the trigger support arm comprising a first member and a second member, the second member extended approximately along the vertical direction, the first member extended from the second member approximately along the transverse direction, the second member comprising a slot defined therethrough, whereby the trigger support arm is located to the slide assembly via the slot, wherein the second member defines a first end and a second end spaced apart approximately along the vertical direction, wherein the second member comprises a center portion positioned approximately equidistance between the first end and the second end, and wherein slot is defined through the center portion.

2. The dishwashing appliance of claim 1, wherein the first member is extended from the center portion of the second member approximately along the transverse direction.

3. The dishwashing appliance of claim 1, wherein the second member comprises a first hole defined therethrough and a second hole defined therethrough, wherein the first hole is positioned proximate to the first end, and wherein the second hole is positioned proximate to the second end.

4. The dishwashing appliance of claim 3, wherein the trigger assembly further comprises a trigger head, wherein the trigger head comprises a pin extended approximately along the lateral direction, wherein the trigger head is attached to the first end of the second member, and wherein the pin is engaged with the first hole.

5. The dishwashing appliance of claim 3, wherein the trigger assembly further comprises a trigger head, wherein the trigger head comprises a pin extended approximately along the lateral direction, wherein the trigger head is attached to the second end of the second member, and wherein the pin is engaged with the second hole.

6. The dishwashing appliance of claim 1, wherein the slide assembly further comprises an inner rail, wherein the inner rail comprises a flange, wherein the flange is protruded from the inner rail approximately along the lateral direction, and whereby the trigger support arm is located to the slide assembly via the flange engaging with the slot.

7. The dishwashing appliance of claim 6, wherein the trigger support arm further comprises a support tab, wherein the support tab is extend from the first member approximately along the lateral direction, wherein the inner rail defines a first end and a second end spaced apart approximately along the transverse direction, wherein the inner rail comprises a support slot defined therethrough, wherein the support slot is positioned between the first end and the second end, wherein the support tab is positioned within the support slot, and wherein the flange is positioned between the support slot and the second end.

8. A trigger assembly of a slide assembly for a dishwashing appliance, the slide assembly defining a vertical direction, a lateral direction, and a transverse direction, the slide assembly comprising a soft close mechanism, the trigger assembly comprising:

a trigger support arm, the trigger support arm comprising a first member and a second member, the second member extended approximately along the vertical direction, the first member extended from the second member approximately along the transverse direction, the second member comprising a slot defined therethrough, whereby the trigger support arm is located to the slide assembly via the slot, wherein the second member defines a first end and a second end spaced apart approximately along the vertical direction, wherein the second member comprises a center portion positioned approximately equidistance between the first end and the second end, and wherein the slot is defined through the center portion.

9. The trigger assembly of claim 8, wherein the first member is extended from the center portion of the second member approximately along the transverse direction.

10. The trigger assembly of claim 8, wherein the second member comprises a first hole defined therethrough and a second hole defined therethrough, wherein the first hole is positioned proximate to the first end, and wherein the second hole is positioned proximate to the second end.

11. The trigger assembly of claim 10, wherein the trigger assembly further comprises a trigger head, wherein the trigger head comprises a pin extended approximately along the lateral direction, wherein the trigger head is attached to the first end of the second member, and wherein the pin is engaged with the first hole.

12. The trigger assembly of claim 10, wherein the trigger assembly further comprises a trigger head, wherein the trigger head comprises a pin extended approximately along the lateral direction, wherein the trigger head is attached to the second end of the second member, and wherein the pin is engaged with the second hole.

13. The trigger assembly of claim 8, wherein the slide assembly further comprises an inner rail, wherein the inner rail comprises a flange, wherein the flange is protruded from the inner rail approximately along the lateral direction, and whereby the trigger support arm is located to the slide assembly via the flange engaging with the slot.

14. The trigger assembly of claim 13, wherein the trigger support arm further comprises a support tab, wherein the support tab is extend from the first member approximately along the lateral direction, wherein the inner rail defines a first end and a second end spaced apart approximately along the transverse direction, wherein the inner rail comprises a support slot defined therethrough, wherein the support slot is positioned between the first end and the second end, wherein the support tab is positioned within the support slot, and wherein the flange is positioned between the support slot and the second end.

* * * * *